United States Patent [19]

Vogelsberg

[11] Patent Number: 4,493,182

[45] Date of Patent: Jan. 15, 1985

[54] DRIVING DEVICE FOR TWISTING HEADS OF AN SZ TWISTING MACHINE

[75] Inventor: Dieter Vogelsberg, Coburg, Fed. Rep. of Germany

[73] Assignee: Siemens Aktiengesellschaft, Munich, Fed. Rep. of Germany

[21] Appl. No.: 478,519

[22] Filed: Mar. 24, 1983

[30] Foreign Application Priority Data

Mar. 25, 1982 [DE] Fed. Rep. of Germany ..... 3211260

[51] Int. Cl.[3] ..... H01B 13/04

[52] U.S. Cl. ..... 57/293; 57/92; 57/100; 57/294

[58] Field of Search ..... 57/293, 294, 92, 93, 57/100, 104, 105

[56] References Cited

U.S. PATENT DOCUMENTS

| | | | |
|---|---|---|---|
| 3,373,550 | 3/1968 | Symonds | 57/294 |
| 3,507,108 | 4/1970 | Yoshimura et al. | 57/294 |
| 3,808,787 | 5/1974 | Vogelsberg | 57/294 |
| 3,823,536 | 7/1974 | Vogelsberg et al. | 57/294 |
| 4,006,582 | 2/1977 | Gurkaynak et al. | 57/294 |
| 4,214,432 | 7/1980 | Scheidt | 57/293 |

FOREIGN PATENT DOCUMENTS

| | | |
|---|---|---|
| 0004295 | 10/1979 | European Pat. Off. . |
| 2516150 | 4/1976 | Fed. Rep. of Germany . |

OTHER PUBLICATIONS

Zietschrift, "Wire Journal", 1978, pp. 74–79, Feb. 1978.

*Primary Examiner*—John Petrakes

*Attorney, Agent, or Firm*—Kenyon & Kenyon

[57] ABSTRACT

The driving device for the twisting head of an SZ stranding machine assures short switching times with little equipment even for a multi-step change of the rotary motion by associating with one or both magnetic clutches of the twisting head either one driving shaft rotating at changing speed, or at least two driving shafts revolving at constant speed and each having a magnetic clutch for coupling rotation to the twisting head clutch.

12 Claims, 7 Drawing Figures

DRIVING DEVICE FOR TWISTING HEADS OF AN SZ TWISTING MACHINE

BACKGROUND OF THE INVENTION

This invention relates to twisting and stranding technology for electric or optical cables and lines in general and more particularly to the mechanical design of a driving device by means of which the rotary motion of a rotating twisting head of an SZ stranding machine can be changed periodically between at least three states of motion lasting for intervals, i.e. in several steps.

In driving SZ stranding machines for electric or optical cables and lines it is important, in view of the spacing of the reversal points of the twist direction in the material to be twisted, that the change of the rotary motion of the rotating twisting tool be accomplished as quickly as possible. It is therefore desirable to keep the masses to be reversed as small as possible. One known driving device, described in DE-AS No. 25 16 150, which meets this requirement and has found acceptance in practice, for this purpose, arranges the twisting tool itself and its driving wheels on a common, rotatable hollow shaft, through which the material to be twisted is brought. The driving wheels are rotatably supported on the hollow shaft. A magnetic clutch arranged on the hollow shaft is associated with each drive wheel. The rotor of the clutch is firmly connected to the hollow shaft. It is assumed here that the rotary motion of the twisting head alternatingly takes two different states. Several such twisting heads may be arranged working in parallel, where the speeds and the change in direction of rotation of the twisting heads are controlled by an electronic device ("Wire Journal", 1978, pages 74 to 79).

It is further known to change the rotary motion of the rotating twisting heads of an SZ twisting machine in several steps in order to increase the distances between change in direction of twist in the material to be twisted. The design of the driving device for these twisting heads is not described in detail. (EP-OS 0 004 295).

Starting from a driving device for a twisting head of an SZ stranding machine for electric or optical cables, by means of which the rotary motion of the twisting head is periodically changed in steps, and in which two driving wheels of the twisting head are rotatably supported on a rotatable hollow shaft and a twisting tool itself and the rotor of a magnetic clutch associated with each driving wheel are firmly connected to the hollow shaft, it is an object of the present invention to provide a driving device which ensures, with a small amount of equipment, the rapid reversal of the rotary motion of the twisting head even where the rotary motion is changed between at least three motion states which last for intervals.

SUMMARY OF THE INVENTION

According to the present invention, for solving this problem, one or both magnetic clutches of the twisting head have associated therewith a drive shaft rotating with at least two alternating speeds or one or both magnetic clutches of the twisting head have associated therewith at least two clutches which are arranged on drive shafts rotating at different constant speeds.

In such a driving device a separate magnetic clutch is therefore not associated with each motion state, i.e., with each speed n including n=0 of the twisting head on the hollow shaft of the twisting head. Rather, two already existing magnetic clutches are utilized more than once by selective coupling to different drive shafts or to a drive shaft rotating at respectively different speeds. This multiple utilization is accomplished without delay of the reversal times of the twisting tool itself particularly if there is coupled, to the respective twisting head, between the alternating coupling to the one drive shaft at one or the other speed, the speed of another driving shaft or if, between the alternating coupling of the clutches associated with the one magnetic clutch, a different speed associated with the other magnetic clutch is coupled to the respective twisting head. In this manner, the switching of the driving shafts or the change from one driving shaft to the other can be accomplished even before the twisting tool itself is switched from the one magnetic clutch to the other. Accordingly, the switching or change of the driving shafts has no delaying reaction on the switching of the magnetic clutches. Consequently, no particularly stringent requirements are necessary as to the switching time for the driving shafts.

The new driving device is suited particularly for SZ stranding machines for the stranding of communication cables since, in these, several stranding groups are manufactured as a rule in parallel operations and, consequently, at least two twisting heads are arranged working in parallel. So that here the twisting heads can be switched, if possible, individually, it is advisable to equip each driving shaft with at least two clutches, one of which is associated with one group of the twisting heads and the other, with another group of the twisting heads. Thereby, good decoupling conditions are provided. In other words, for the purpose of electrical decoupling of the twisted groups which later lie side by side in the twisted assembly, one or more twisting heads can be coupled to the drive means singly or in groups phase-shifted relative to the other twisting heads.

DETAILED DESCRIPTION

Figure 1:
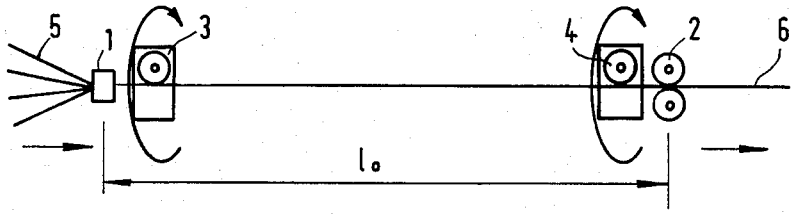
FIG. 1 shows the basic design of an SZ stranding machine.

The SZ twisting device according to FIG. 1 consists of a first twisting closer 1 with a rotating twisting head 3 arranged immediately thereafter, and of a second twisting point 2 with a rotating twisting head 4 arranged immediately ahead of it. Both twisting heads use a deflection roll, over which the material to be twisted is looped once, as the twisting tool itself.

With the SZ twisting device shown, elements to be twisted 5, for instance, two or four conductors, are twisted to a twisted group 6, for instance, a pair or a spiral quad. The rotary motion of the twisting heads 3 and 4 is changed synchronously at intervals which correspond approximately to the transit time of a longitudinal section of the material to be twisted from the first twisting closer 1 to the second twisting closer 2, where these are spaced a distance $l_0$.

Figure 2:
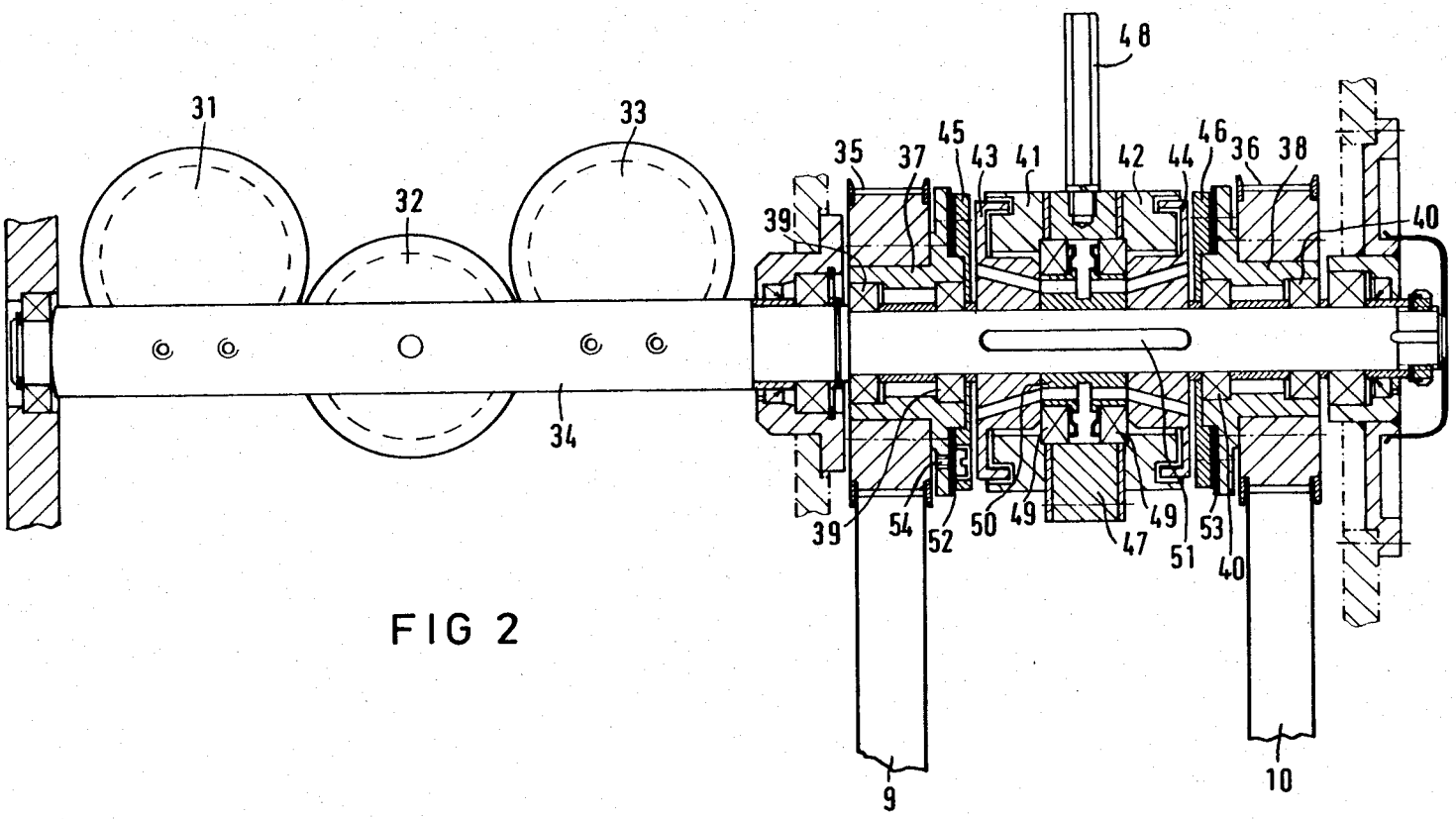
FIG. 2 is a view partly in cross section of a known design of a twisting head with a driving device.

The twisting heads 3 and 4 may be designed, for instance, according to FIG. 2. The twisting tool itself comprises, in this case, the three deflection pulleys 31, 32 and 33, between which the material to be twisted runs in wavy fashion. These deflection pulleys are mounted on a hollow shaft 34, through which the material to be twisted passes. Furthermore, on the hollow shaft 34, part of the driving device of the twisting head is mounted. This device consists, first, of two driving wheels 35 and 36 which are fastened on flanges 37 and 38 and are supported rotatably on the hollow shaft 34 via bearings 39 and 40.

With each driving wheel is associated a magnetic clutch which consists of the stator 41 or 42, respectively, the rotor 43 and 44, respectively, and the aramature disc 45 or 46, respectively. The stators 41 and 42, at which the windings of the magnetic clutch are arranged, are fastened on a common support body 47 into which a holding pin 48 is screwed. This holding pin is braced against the housing of the twisting head in a manner not shown in detail. The stators 41 and 42 are supported via bearings 49 on a support body 50 which is firmly connected via a key 51 to the hollow shaft 34 in the same manner as the adjacent rotors 43 and 44.

The armature discs 45 and 46 of the magnetic clutches are connected to diaphragm springs 52 and 53 which are in turn fastened by means of the screws 54 to the flanges 37 and 38, respectively, of the driving wheels 35 and 36.

For operating the twisting head, the driving wheels 35 and 36, which are coupled via serrated belts 9 and 10 to driving shafts, not shown in detail, rotate at a speed and/or direction of rotatation which changes at intervals. The hollow shaft 34 is driven via the magnetic clutches at the respectively required speed and or direction of rotation.

Figure 3:
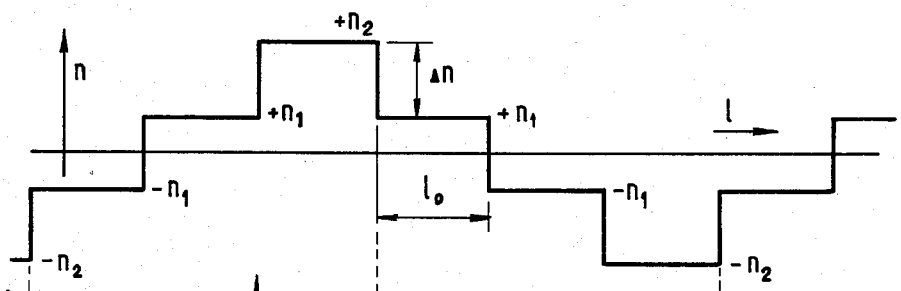
FIGS. 3, 4, 5 and 7 are diagrams illustrating the course of speeds and twists.
Figure 4:
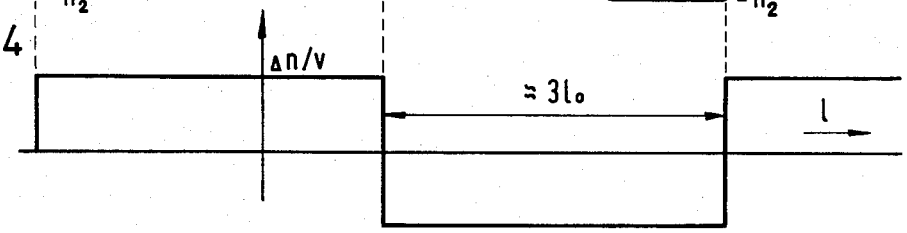

FIG. 3 shows a given speed program for a twisting head 3 where six steps with four different motion states with different directions of rotation are provided within a twisting period. The twisting head is to assume sequentially the speed $-n_2$, $-n_1$, $+n_1$, $+n_2$, $+n_1$, $-n_1$, $-n_2$, etc. As is evident from FIG. 3, each of the speeds is maintained for an equal period of time. Thus, each speed is maintained until a longitudinal section of the material to be twisted has travelled the length $l_0$ between the twisting closers 1 and 2. From this speed program an SZ twist of the material to be twisted which is shown in FIG. 4 results. Accordingly, successive twisting sections with different direction of twist are obtained, where each twisting section of constant direction has approximately the length $3l_0$. The distance of the reversal points of the twist direction is therefore approximately three times as large as the distance of the twisting closers 1 and 2 from each other.

Figure 5:
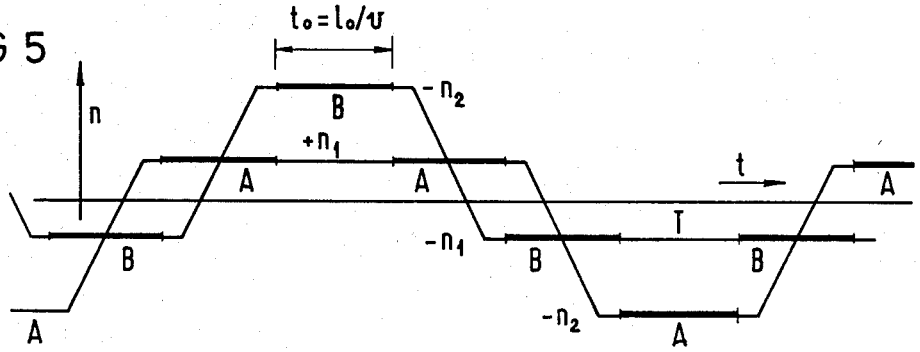

The operation of a twisting head 3 according to a speed program according FIG. 3 can be achieved by means of two driving shafts which, according to FIG. 5, have a trapazoidal speed curve with a speed $-n_1$ and $+n_2$, or $-n_2$ and $+n_1$ respectively. The twisting head is coupled here via appropriate clutches for respective time intervals A and B to the driving shafts such as are shown in FIG. 5 by the bold line section.

Figure 6:
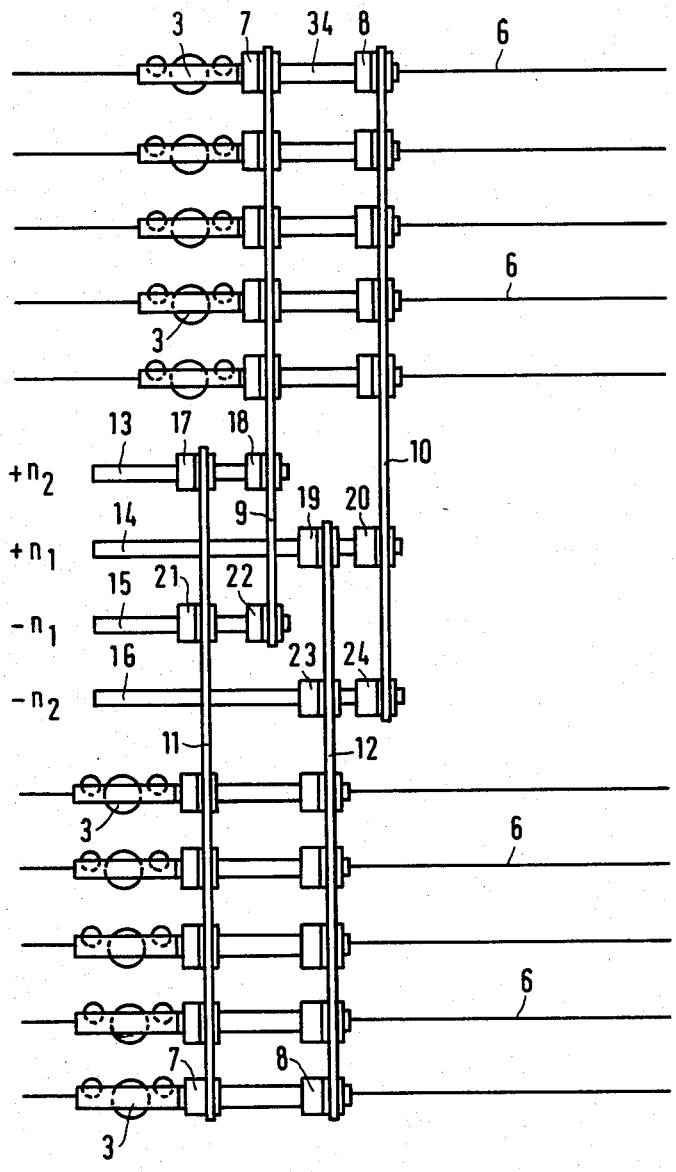
FIG. 6 is a schematic view of a specific relation of driving shafts and twisting heads.

The embodiment according to FIG. 6 shows ten SZ twisting heads 3 arranged to operate in parallel for producing twisting groups 6, on the hollow shafts 34 of which two magnetic clutches 7 and 8 each are arranged. With the twisting heads are associated four driving shafts 13, 14, 15 and 16 which rotate at constant speeds $+n_2$, $+n_1$, $-n_1$ and $-n_2$. Each driving shaft is equipped with two clutches 17, 18; 19, 20; 21, 22 and 23, 24 respectively. The twisting heads 3 are divided into two groups, where each group is associated with one clutch of each driving shaft. The clutches are connected via the driving belts 9, 10, 11 and 12 to the two groups of the twisting heads, the clutches of two different driving shafts, 13, 14, 15 or 16 being associated with each magnetic clutch 7 or 8.

Figure 7:
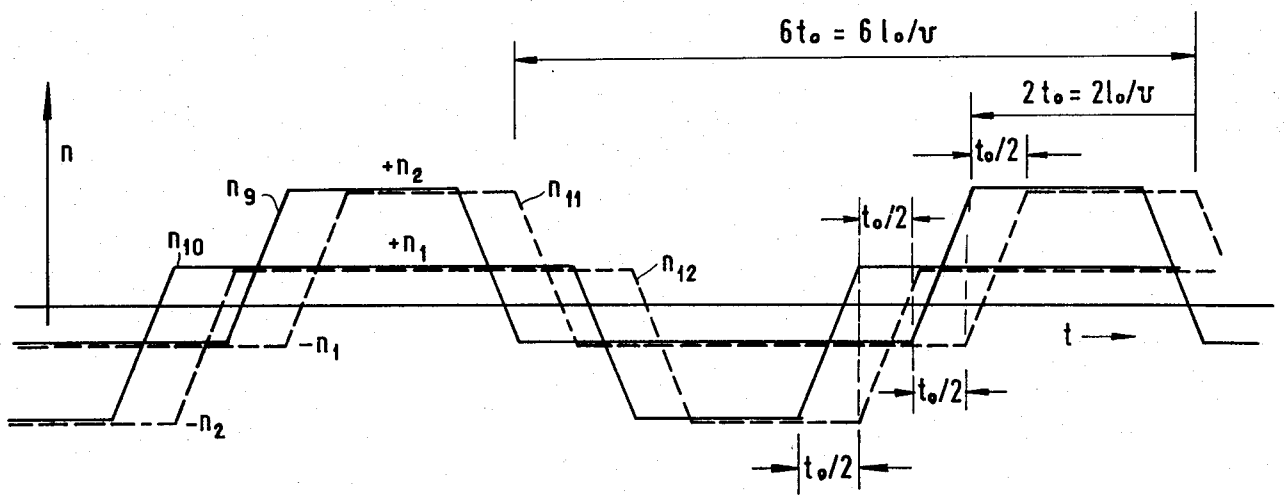

For the driving wheels of the magnetic clutches 7 and 8 of the driving device according to FIG. 6, a speed program can be developed as is shown in FIG. 7. Accordingly, the two driving wheels of all twisting heads of the one twisting head group and the two driving wheels of all twisting heads of the other twisting head group rotate at speeds, the course of which is given, according to the associated drive belts 9, 10, 11 and 12, as $n_9$ to $n_{12}$. The change of the speeds of the individual driving wheels is mutually offset here by the value $t_0/2$. It is ensured thereby that within a twisting period, all speeds $+n_1$, $+n_2$, $-n_1$ and $-n_2$ are available to each twisting head, with uniform staggering in time of the speed programs of all twisting heads shown in FIG. 3.

Instead of using four driving shafts 13, 14, 15 and 16 rotating at constant speed each having two associated clutches according to FIG. 6, four motor drives associated with the drive belts 9, 10, 11 and 12 can be also used, the speeds $n_9$, $n_{10}$, $n_{11}$, $n_{12}$ of which are changed at intervals according to FIG. 7.

Taking into consideration the embodiment according to FIGS. 6 and 7, driving devices with three or five different motion states can also be realized, where the speeds of the driving wheels of the magnetic clutches can be assigned to each other within wide limits.

What is claimed is:

1. A driving device for a twisting head of an SZ stranding machine for electrical or optical cables, by means of which the rotary motion of the twisting head is periodically changed in steps, the twisting head including first and second driving wheels rotatably supported on a rotatable hollow shaft; a twisting tool; first and second magnetic clutches, associated with the first and second driving wheels, with stators and rotors, and the rotors of said first and second magnetic clutches and said twisting tool firmly connected to the hollow shaft, comprising:

first means adapted to rotate at at least a first speed;

second means adapted to alternately rotate at at least second and third speeds;

means coupling said first means to said first driving wheel; and means coupling said second means to said second driving wheel, whereby at least three motion states can be provided for predetermined time intervals.

2. A driving device according to claim 1 wherein said second means comprise a drive shaft adapted to rotate alternatingly with at least two speeds.

3. A driving device according to claim 1 wherein said second means comprise first and second drive shafts rotating at different constant speeds and first and second clutches for selectively connecting said first and second drive shafts to said means coupling.

4. A driving device according to claim 1 for at least two twisting heads arranged to operate in parallel, comprising at least two clutches coupled to said second means, one associated with one of said twisting heads and the other with the other twisting head.

5. A driving device according to claim 4 wherein two groups of twisting heads are provided and said one clutch is associated with one group and the other with the other group.

6. A driving device according to claim 1 wherein said first means are adapted to rotate at first and fourth speeds.

7. A method of operating a driving device for a twisting head of an SZ stranding machine for electrical or optical cables, said twisting head having a hollow shaft; first and second driving wheels rotatably supported on said shaft; a twisting tool; first and second magnetic clutches one for each driving wheel each having a rotor, the rotors and said twisting tool firmly connected to said shaft, said driving device comprising: first drive means adapted to rotate at at least a first speed; second drive means adapted to rotate alternatingly at at least second and third speeds and means for coupling said first and second drive means to said first and second driving wheels respectively, comprising:

a. operating said second magnetic clutch to alternately rotate said twisting device at said second speed and third speed; and, b. in between operating said second clutch to cause rotation at said second and third speeds, operating said first clutch to cause rotation at said first speed.

8. The method according to claim 7, comprising coupling at least first and second twisting heads to said first and second drive means such that there is a phase shift in the sequence of operating speeds between said first and second twisting heads.

9. The method according to claim 8 wherein first and second groups of twisting heads are provided.

10. The method according to claim 9, and further including operating for equal periods of time at each of said first, second and third speeds.

11. The method according to claim 7 wherein said first means is adapted to alternatingly rotate at first and fourth speeds.

12. A driving device according to claim 1, wherein said first and second means are adapted to maintain each of said first, second and third speeds for equal periods of time to thereby result in equal lengths of constant twist direction.

* * * * *